United States Patent [19]

Grass

[11] Patent Number: 5,056,192

[45] Date of Patent: Oct. 15, 1991

[54] PROTECTIVE COVER FOR SINGLE AND MULTIPLE ARTICULATION HINGES

[75] Inventor: Alfred Grass, Hochst/Vlbg., Austria

[73] Assignee: Grass AG, Hochst/Vlbg., Austria

[21] Appl. No.: 551,196

[22] Filed: Jul. 11, 1990

[30] Foreign Application Priority Data

Jul. 24, 1989 [DE] Fed. Rep. of Germany ..... 3924385

[51] Int. Cl.[5] ..... E05D 11/00

[52] U.S. Cl. ..... 16/251

[58] Field of Search ..... 16/250, 251

[56] References Cited

U.S. PATENT DOCUMENTS 2,274,160 2/1942 Porter ..... 16/251
4,856,141 8/1989 Sassenberg ..... 16/251
4,870,716 10/1989 Gass ..... 16/250

FOREIGN PATENT DOCUMENTS 2655831 6/1978 Fed. Rep. of Germany ..... 16/251
2721582 11/1978 Fed. Rep. of Germany ..... 16/250
2753522 6/1979 Fed. Rep. of Germany .
3239041 5/1984 Fed. Rep. of Germany .

*Primary Examiner*—Richard K. Seidel
*Assistant Examiner*—Edward A. Brown

[57] ABSTRACT

A protective cover for a hinge has a band-like cover strip which extends longitudinally relative to the hinge and has one end connected with the hinge barrel and the other end of the cover strip connected with the hinge arm. The cover strip is longitudinally elastic and flexible and covers at least the respective top sides of the hinge barrel and the hinge arm. The cover strip can have a U-shaped cross section.

13 Claims, 4 Drawing Sheets

29
9
4,14,24

31
32
34

24
25

27
28
30
33

17
18
18

19
20
21

21
22
22

PROTECTIVE COVER FOR SINGLE AND MULTIPLE ARTICULATION HINGES

FIELD AND BACKGROUND OF THE INVENTION

The present invention relates to a cover as jamming protection for single or multiple articulation hinges, in which at least the top side of the hinge barrel and of the hinge arm articulating with the hinge barrel is covered with a protective cover, the one end thereof being connected with the hinge barrel and the other end of the protective cover being connected with the hinge arm.

DESCRIPTION OF THE PRIOR ART

This type of cover has been disclosed, for example, with the subject matter of DE 27 21 582 A1. In this case, the cover consists of a protective cover bending into itself that cannot be adjusted in length. This protective cover articulates at its one end with the hinge arm and at its other end with the hinge barrel. The protective cover is bent in the closing position, while it covers the gap between the hinge arm and the hinge barrel in the open position.

The disadvantage of this known protective cover, however, is that the protective cover lifts up from the hinge during the transition from the open position to the closing position, which causes a space in the articulation gap of the hinge, so that there is a risk of lateral jamming in this uncovered articulation gap.

The subject matter of DE 27 53 522 C2 discloses a further protective cover that cannot be adjusted in length, being in a fixed connection at its one end with the hinge arm and in a displaceable connection arrangement at it other end with the opposite part of the hinge. This type of guide is relatively expensive, however, and requires special selection of the material for the protective cover.

A similar design is also disclosed in DE 32 39 041 A1.

SUMMARY OF THE INVENTION

The object of the invention, therefore, is to improve a cover as jamming protection for single or multiple articulation hinges of the type mentioned in the beginning so as to ensure a jamming protection device that is simple to mount and provides optimum protection at minimum manufacturing cost.

The object of the invention is achieved in that the protective cover is designed as an elastic cover that is at least longitudinally elastic.

The field of application of the present invention includes all known single or multiple articulation hinges. The important thing is that the protective cover according to the invention achieves a protective effect for the articulation gap of the hinge concerned.

The use of an elastic cover that is at least longitudinally elastic achieves optimum protection, because there is no lift-off motion in the transition from the open to the closing position or the reverse.

One such elastic cover that is at least longitudinally elastic would be a rubber band that is clamped on the hinge barrel and on the rear end of the hinge clamp. This rubber band is longitudinally elastic, that is, it can be adjusted in length on stretching. Provision can also be made in a further development of the present invention for the protective cover to be not only adjustable in length but also capable of transverse strain, that is, lateral areas of the two hinge parts articulating with each other can also be covered thereby.

In the simplest case, the protective cover has a flat shape. That is, it provides a plate-like cover over the parts of the hinge articulating with each other. A further development of the invention provides for a U-shape or a C-shape instead of a flat shape. This ensures that not only the top sides of the hinge but also the lateral surfaces are covered. One of the advantages of this is that, when the hinge is mounted, fingers are protected from getting into the articulating gap from the top or the bottom.

There are a number of possible and preferred embodiments for designing the protective cover as an elastic cover that is at least longitudinally elastic.

A first embodiment was represented above as a rubber band. In addition, there are a number of further possibilities for longitudinally elastic design of such protective covers. They involve knitted or woven fabrics that are all at least adjustable with respect to length, and are also capable of transverse strain.

The important thing is that the elastic cover covers at least the surface of the hinge by virtue of its longitudinal elasticity and, preferably, the side faces as well by virtue of transverse elasticity.

Knitted or woven fabrics of this type may or may not also contain rubber or textile threads with their own longitudinal elasticity. A knitted or woven fabric is also longitudinally elastic and possibly transversely elastic when a corresponding tensile stress is applied in the given direction because the mesh structure changes thereby.

If a change in the mesh structure is not desired, rubber threads can also be worked into the fabric made of textile fibers, or the knitted or woven fabric can be produced with rubber threads alone.

The invention is not restricted to the use of longitudinally elastic fabrics, however. In a further development of the invention, the fabric is replaced by a continuous shape having suitable longitudinal elasticity. Such longitudinally elastic covers include longitudinally elastic rubber covers as well as covers made of foamed or extruded plastic.

In a further development, the elastic cover consists of a longitudinally elastic metal wire mesh. The threads of this elastic cover are longitudinally extensible in the longitudinal and possibly the transverse direction, for example, in the form of coil or helical springs as used for a metal wire grid on a bed-frame.

To return to the described preferred embodiment of the elastic cover made of a longitudinally elastic knitted or woven fabric, it may be added that, when a coarse fabric is used, the adjusting components of the hinge arm lying below are accessible through the mesh structure of this fabric by means of a screwdriver without making special openings in the protective cover for this purpose.

If a fine weave is used, cut-outs are provided for passage of a tool to the adjusting components arranged in the hinge arm.

Provision is also made for the protective cover to be separably connected with the parts of the hinge. Such a separable mounting can be by means of hooking components, the protective cover having suitable hook-shaped ends, the one end being separably connected with the hinge barrel and the other being separably connected with the hinge arm.

The longitudinally elastic cover can be given designs in different colors with or without an inscription. Similarly, an especially esthetic overall impression can also be achieved with a transparent elastic strip that will allow easy recognition of the hinge lying below.

The subject matter of the present invention is indicated not only by the subject matter of the individual patent claims but also by a combination of the individual patent claims with each other. All data and features disclosed in the documents, including the summary, particularly the spatial configurations represented in the drawings, are claimed as essential to the invention to the extent that they are novel compared to the prior art either individually or in combination.

BRIEF DESCRIPTION OF THE DRAWINGS

The invention is explained in more detail below using drawings representing a number of embodiment approaches. The drawings and their description indicate further features essential to the invention as well as further advantages of the invention.

DETAILED DESCRIPTION OF THE DRAWING

Figure 1:
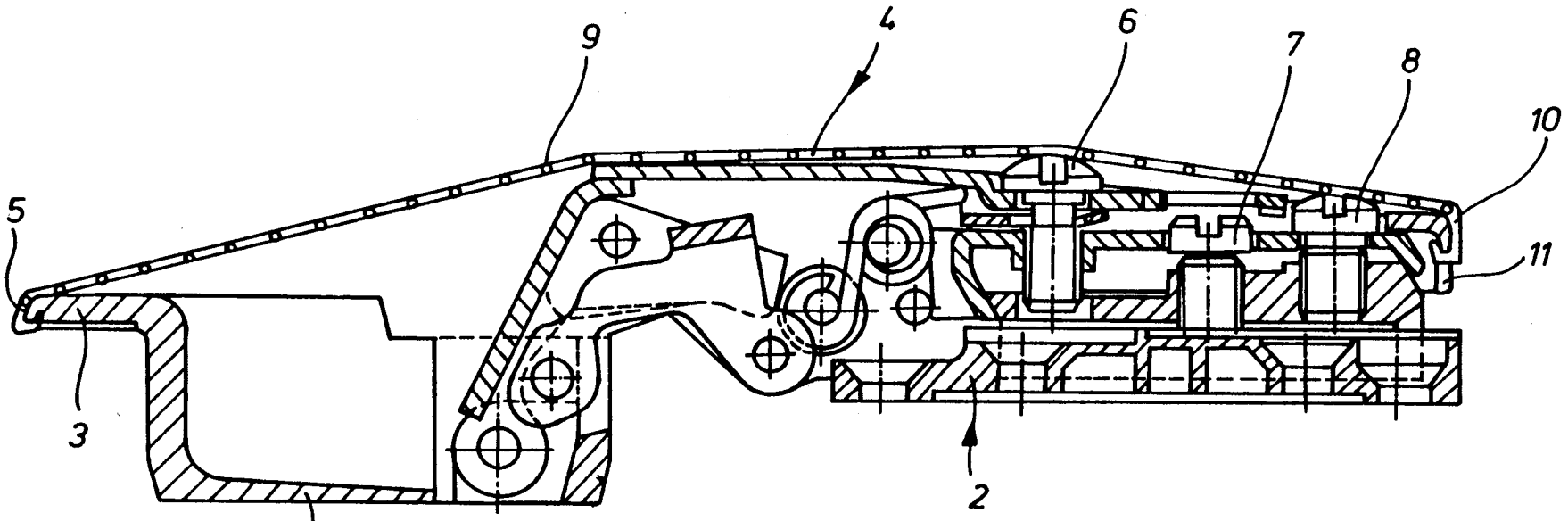
FIG. 1 is a section through a two-articulation hinge in the open position with protective cover.
Figure 2:
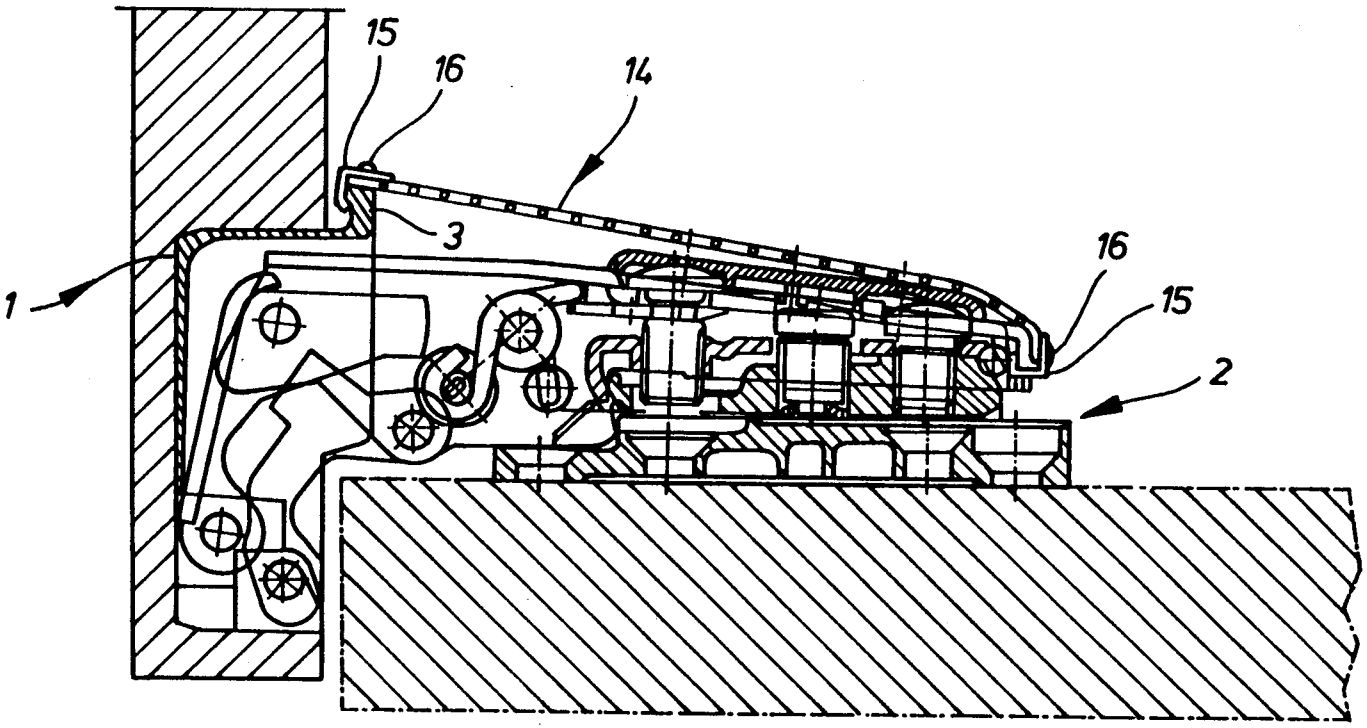
FIG. 2 is a section through the hinge of FIG. 1 in the closing position with a modified mounting of the protective cover.

A known two-articulation hinge is represented in the example embodiments according to FIGS. 1 and 2; it consists of a hinge barrel 1 and a hinge arm 2 articulating thereon through toggle joints.

According to FIG. 1, the hinge barrel and the hinge arm are covered at least at the top by an elastic cover, which is suspended from and fixed on the upper flange of the hinge barrel 1 with a hook-shaped end 5.

It thus covers all parts, particularly the area of the hinge barrel where injuries can be caused, so that fingers can no longer be inserted into the hinge barrel 1 from the top or the side.

At the rear end of the hinge arm 2, the elastic cover 4 has a similar hook-shaped end with which it is suspended from the cover clamp 11 of the hinge arm 2.

The elastic cover 4 consists in this case of a lattice-like, longitudinally elastic, knitted or woven fabric, and it can be seen that the transverse threads 9 run at right angles with the longitudinal axis of the hinge.

This causes a broadening of the interval between the transverse threads 9 in the open position of the hinge, so that the adjusting screws 6, 7, 8 arranged under the elastic cover 4 are easily accessible to a tool (e.g., a screwdriver) penetrating through the elastic cover, which is not damaged thereby.

Other types of mounting are possible in addition to the separable mounting represented in FIG. 1. FIG. 2 represents one such mounting. In this case, an elastic cover 14 is fastened by means of a hook-shaped clamping component 15 on the upper edge 3 of the hinge barrel 1 using a tensioning screw 16.

The same fastening is carried out at the rear end of the hinge arm 2 using a clamping component 15 with a tensioning screw here too.

Figure 3:
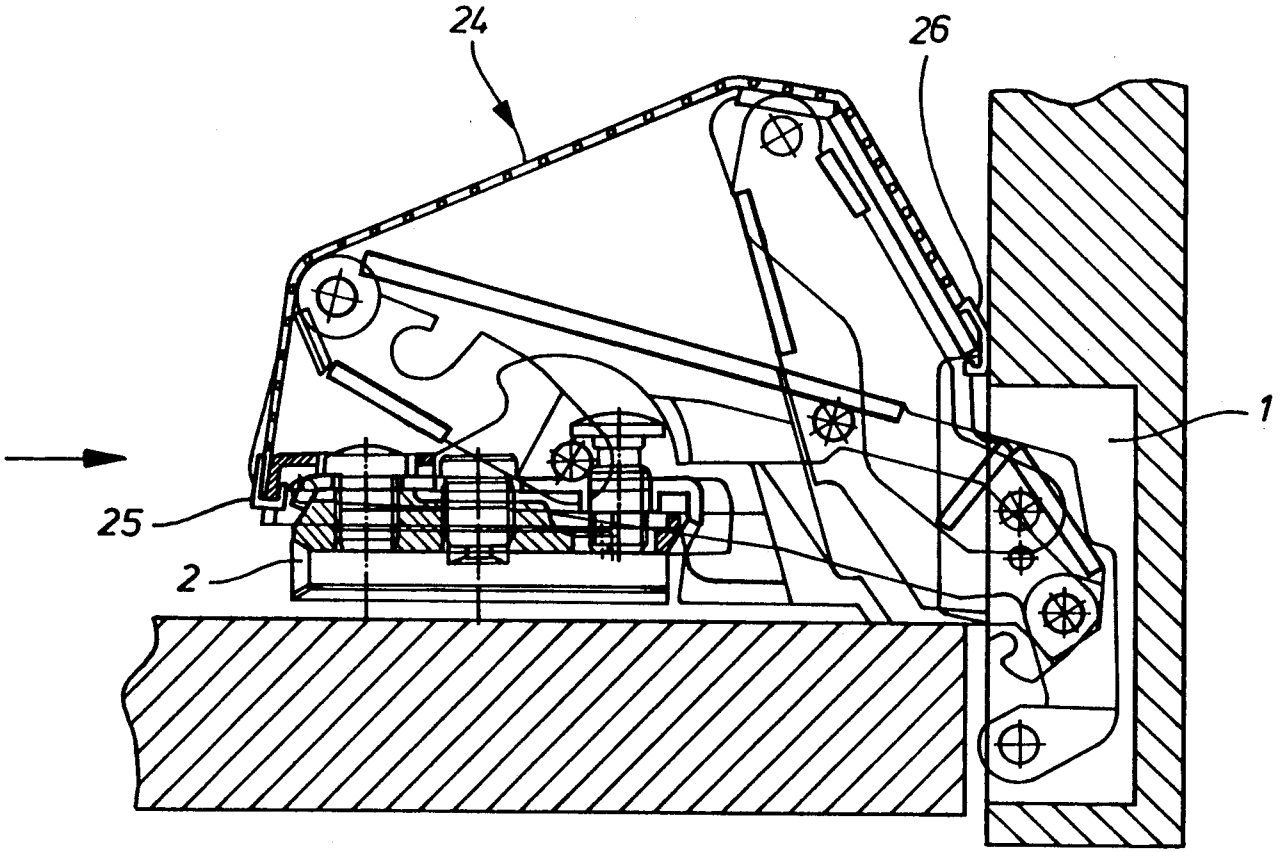
FIG. 3 is a section through a wide-angle hinge in the closing position.
Figures 4, 5, 6, 7, 8, 9, 10:
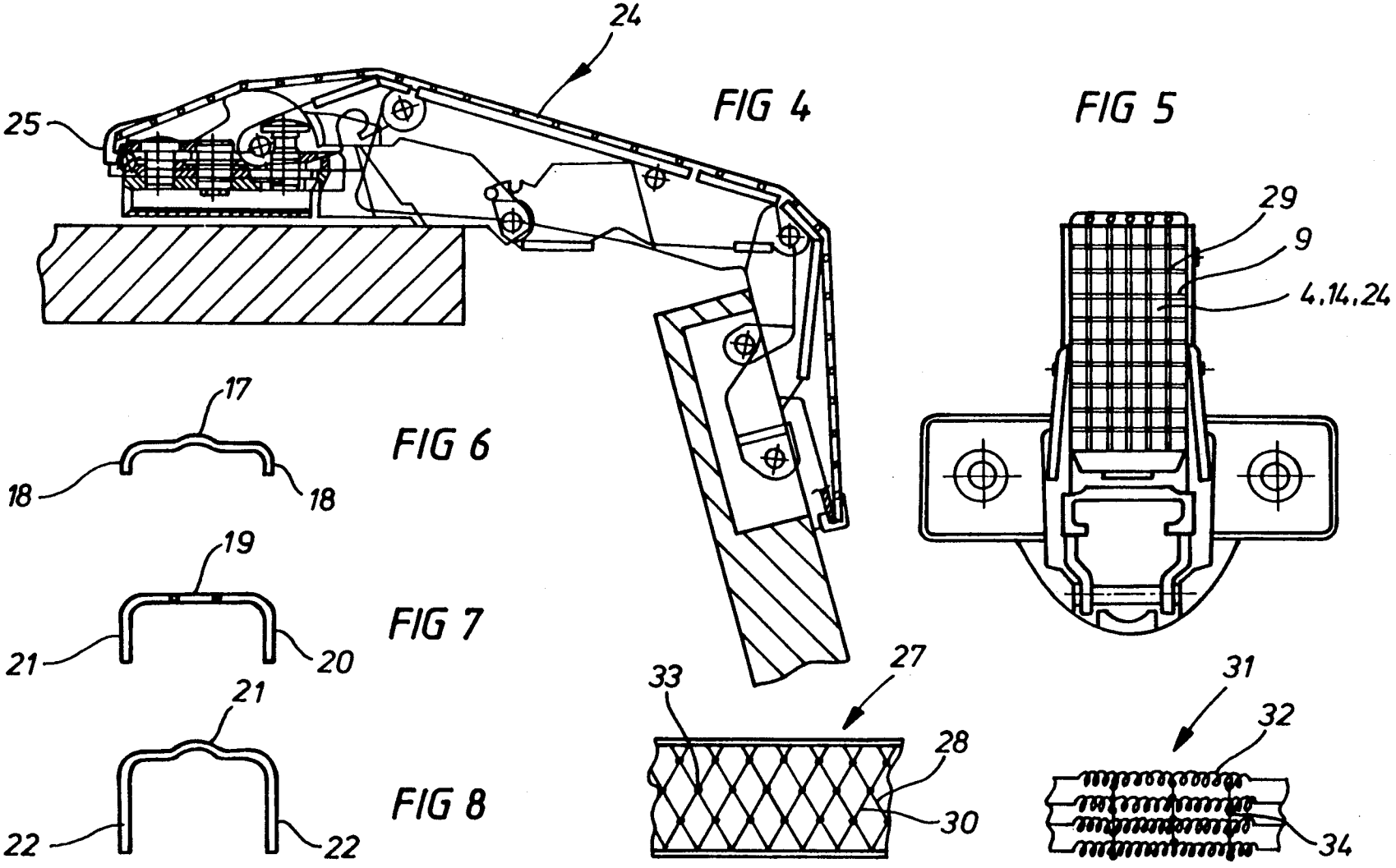
FIG. 4 is a section through the wide-angle hinge of FIG. 3 with a modified mounting for the protective cover.
FIG. 5 is a plan view of the hinge of FIG. 4.
FIG. 6 is a modified embodiment of the protective cover.
FIG. 7 is a second modification of the protective cover.
FIG. 8 is a third modification of the protective cover.
FIG. 9 is a plan view of a protective cover as knitted or woven fabric.
FIG. 10 is a plan view of a protective cover made of a longitudinally elastic metal wire mesh.

FIGS. 3 and 4 show the use of another elastic cover 24 for a wide-angle hinge.

Hooking components 25 are provided here as well; they are mounted on the rear end of the hinge arm 2 and on the upper flange of the hinge arm 1 set in a door.

The hooking components 25, 26 are separably connected with the hinge components here too, and they claw like staples into the elastic cover 24.

FIG. 4 shows that the invented elastic cover 24 ensures optimum cover of the articulation gap of the wide-angle hinge.

FIG. 5 shows an elastic cover 29 that can also be used in the preceding embodiments of FIGS. 1 to 4. This elastic cover consists basically of transverse and longitudinal threads 9, 29, which are in a lattice-like arrangement and may be bonded at the junction points if necessary.

This provides not only longitudinal elasticity but also transverse elasticity, so that this type of elastic cover can also be stretched over the side faces of the hinge arm and the side faces of the toggle joints.

FIGS. 6 to 8 show different designs of elastic covers 17, 19, 21, which consist of a continuous material that is elastic longitudinally and, if necessary, transversely. Such materials include rubber materials as well as foamed or extruded plastics.

The important thing is that the elastic covers be approximately U-shaped or C-shaped, so that the side faces of the hinge arm and of the toggle joints are also covered with the side legs 18, 20, 22. This also prevents the risk of injury to fingers inserted from above or below (parallel with the door joint).

FIG. 9 shows that an elastic cover 27 can also be made with a net-like knitting with longitudinal threads 28 and transverse threads 30.

In this case, the threads 28, 30 are interconnected at the junction points 33.

The elastic cover 31 according to FIG. 10 consists of longitudinally elastic metal wires designed as longitudinal threads 32 in coils or spirals forming small coil springs, which also provides the required longitudinal elasticity.

Rigid or longitudinally elastic transverse connections 34 can be provided in addition; they can connect the longitudinal threads 32 in a parallel spaced arrangement to give the overall structure a certain degree of stability longitudinally and transversely.

The advantage of the protective covers described is that they are elastic components that are simple and economical to produce and easy to assemble. Furthermore, they can be mounted later on hinges already in place and can be delivered separately.

The elastic covers can have any kind of design and are suitable for all opening angles of all hinge types.

They have a long service life, increase the height of the hinge only slightly, and have no guides, articulations or other mechanically sensitive parts. Apart from this, they ensure easy access to the adjustment parts of the hinge, even when the elastic covers completely surround the hinge on all sides.

What is claimed is:

1. A protective cover for a hinge having a hinge arm and a hinge barrel comprising:

a longitudinally elastic and flexible strip-like cover extending longitudinally relative to the hinge and having one end connected with the upper flange of the hinge barrel and the other end of the cover strip connected with the hinge arm and wherein the cover strip covers at least substantially the entire top side of the hinge arm and the upper flange of the hinge barrel.

2. A protective cover as claimed in claim 1 wherein the cover has a substantially U-shaped cross section.

3. A protective cover as claimed in claim 1 wherein the cover embraceably and conformably covers at least substantially the entire top side of the hinge barrel and the upper flange of the hinge barrel.

4. A protective cover as claimed in claim 1 or 2 wherein the cover is formed of a woven fabric.

5. A protective cover as claimed in claim 4 wherein the fabric is woven from rubber threads.

6. A protective cover as claimed in claim 4 wherein the fabric is woven from textile threads.

7. A protective cover as claimed in claim 1 or 2 wherein the cover is formed of a knitted fabric.

8. A protective cover as claimed in claim 7 where the fabric is knitted from rubber threads.

9. A protective cover as claimed in claim 7 wherein the fabric is knitted from textile threads.

10. A protective cover as claimed in claim 1 or 2 wherein the cover is formed of a plastic material.

11. A protective cover as claimed in claim 10 wherein the plastic material is foamed.

12. A protective cover as claimed in claim 10 wherein the plastic material is extruded.

13. A protective cover as claimed in claim 1 or 2 wherein the cover is formed of a metal wire mesh.

* * * * *